US005676003A

United States Patent [19]

Ursel et al.

[11] Patent Number: 5,676,003

[45] Date of Patent: Oct. 14, 1997

[54] BLOCKING DEVICE FOR A MOTOR VEHICLE DOOR

[75] Inventors: Eckhard Ursel, Bühl; Werner Dilger, Bühl-Weitenung; Uwe Schaper, Bühl-Vimbuch, all of Germany

[73] Assignee: Robert Bosch GmbH, Stuttgart, Germany

[21] Appl. No.: 373,307

[22] PCT Filed: Jun. 26, 1993

[86] PCT No.: PCT/DE93/00559

§ 371 Date: Jan. 11, 1995

§ 102(e) Date: Jan. 11, 1995

[87] PCT Pub. No.: WO94/01644

PCT Pub. Date: Jan. 20, 1994

[30] Foreign Application Priority Data

Jul. 11, 1992 [DE] Germany ..... 42 22 868.9

[51] Int. Cl.[6] ..... E05B 13/10

[52] U.S. Cl. ..... 70/472; 70/149; 70/218; 70/264; 292/201; 292/336.3; 292/DIG. 27

[58] Field of Search ..... 292/DIG. 27, 201, 292/336.3; 70/264, 422, 204, 218, 149, 472

[56] References Cited

U.S. PATENT DOCUMENTS

| | | | |
|---|---|---|---|
| 4,904,006 | 2/1990 | Hayakawa et al. | 292/DIG. 27 X |
| 5,066,054 | 11/1991 | Ingenhoven | 292/DIG. 27 X |

FOREIGN PATENT DOCUMENTS

| | | |
|---|---|---|
| 3150620 | 6/1983 | Germany . |
| 4028992 | 9/1991 | Germany . |
| 4131891 | 4/1993 | Germany . |

*Primary Examiner*—Lloyd A. Gall
*Attorney, Agent, or Firm*—Michael J. Striker

[57] ABSTRACT

A central locking system for motor vehicles has all of the opening and closing functions occurring in normal operation also in the event of failure of individual components. If necessary, a vehicle outfitted with this system can also be opened and locked when the door lock motors (50) are out of operation. When the vehicle is locked, the outer door handles (13) can be pulled without meeting resistance and without effect. To this end, a control cam (47) lifts an actuating arm (32) so that a door handle lever (35) can be actuated without the actuating arm (32) being grasped.

20 Claims, 9 Drawing Sheets

BLOCKING DEVICE FOR A MOTOR VEHICLE DOOR

BACKGROUND OF THE INVENTION

The present invention is related to a blocking device. A door lock for a motor vehicle door is known from DE, 31 50 620 A1. In this door lock, which is driven by an electric motor, a rotatable latch is brought into its locked position via a crank mechanism and a knee lever arrangement. This construction requires high motor output and a large number of separate component parts. Moreover, a door which is locked by this device via a motor cannot be opened again in the event of failure of the motor.

SUMMARY OF THE INVENTION

Accordingly, it is an object of the present invention to provide a blocking device for a motor vehicle door, which avoids the disadvantages of the prior art.

In keeping with these objects and with others which will become apparent hereinafter, one feature of the present invention resides, briefly stated in a central locking system for motor vehicles which has all of the opening and closing functions occurring in normal operations also in the event of failure of individual components, when necessary a vehicle provided with the system can be opened and locked when the door lock motors are out of operation, and when the vehicle is locked the outer door handles can be pulled without meeting resistance, for which purpose a control cam lifts an actuating arm so that a door handle lever can be actuated without the actuating arm being grasped.

Compared with the prior art, the blocking device according to the invention has the advantage of a large number of functions, a simple construction and lightly loaded structural component parts. The individual locks of the blocking device are accordingly lighter and smaller and the power to be applied by the motor is reduced to a minimum. In addition, the blocking device is so designed that the vehicle can also be opened and locked mechanically in a conventional manner in the absence of the central locking function in the event of failure of an electrical component.

The construction according to the invention has the additional advantage that the door handles serving to open the doors can be pulled without encountering a load when the vehicle is locked and no forces are exerted on the inner structural component parts of the lock. In this way, the risk of breakage of the structural members in question, which would otherwise be present, is avoided.

Another modification of the inventive blocking device has the additional advantage that the motor need only apply the force required for actuating one of the two unblocking levers at one time. Accordingly, the motor power is reduced by half compared with a simultaneous actuation of both levers.

In a particularly advantageous manner, movable drivers which are preferably arranged at bendable actuating arms are attached to the unblocking levers. These actuating arms can be moved by control segments of the control member into two different positions in which they can either be grasped by door handle levers connected with the door handles or can pass the drivers without effect. The actuating arms have the advantage that they are very light so that only low motor power is required.

The advantage in arranging unblocking levers and door handle levers on a common axle consists in that no additional friction occurs between the unblocking levers and door handle levers when opening the door. This ensures reliable operation of the lock and minimizes the needed force applied by the driver at the door handle.

Thanks to the emergency locking and unlocking levers, the door in question can be opened and closed also if a motor fails or is defective.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

FIG. 1 shows an internal view of a lock in which the motor, motor support and control member are omitted for the sake of simplicity; FIG. 2 shows a view from the same perspective in which the door handle levers are omitted; FIG. 3 shows a top view of the same lock as seen from the side; FIG. 4 shows an internal view as seen from viewing direction IV in FIG. 2; FIGS. 5 and 6 show a control member for the front doors of a motor vehicle with the arrangement of the control sectors; FIGS. 7 to 9 show an unlocked lock; FIG. 10 shows a centrally locked lock; FIGS. 11 and 12 show a child-proof lock; FIGS. 13 and 14 show an anti-theft lock; FIG. 15 shows emergency unlocking; FIGS. 16 and 17 show emergency locking.

DESCRIPTION OF THE PREFERRED EMBODIMENT

Figure 1:
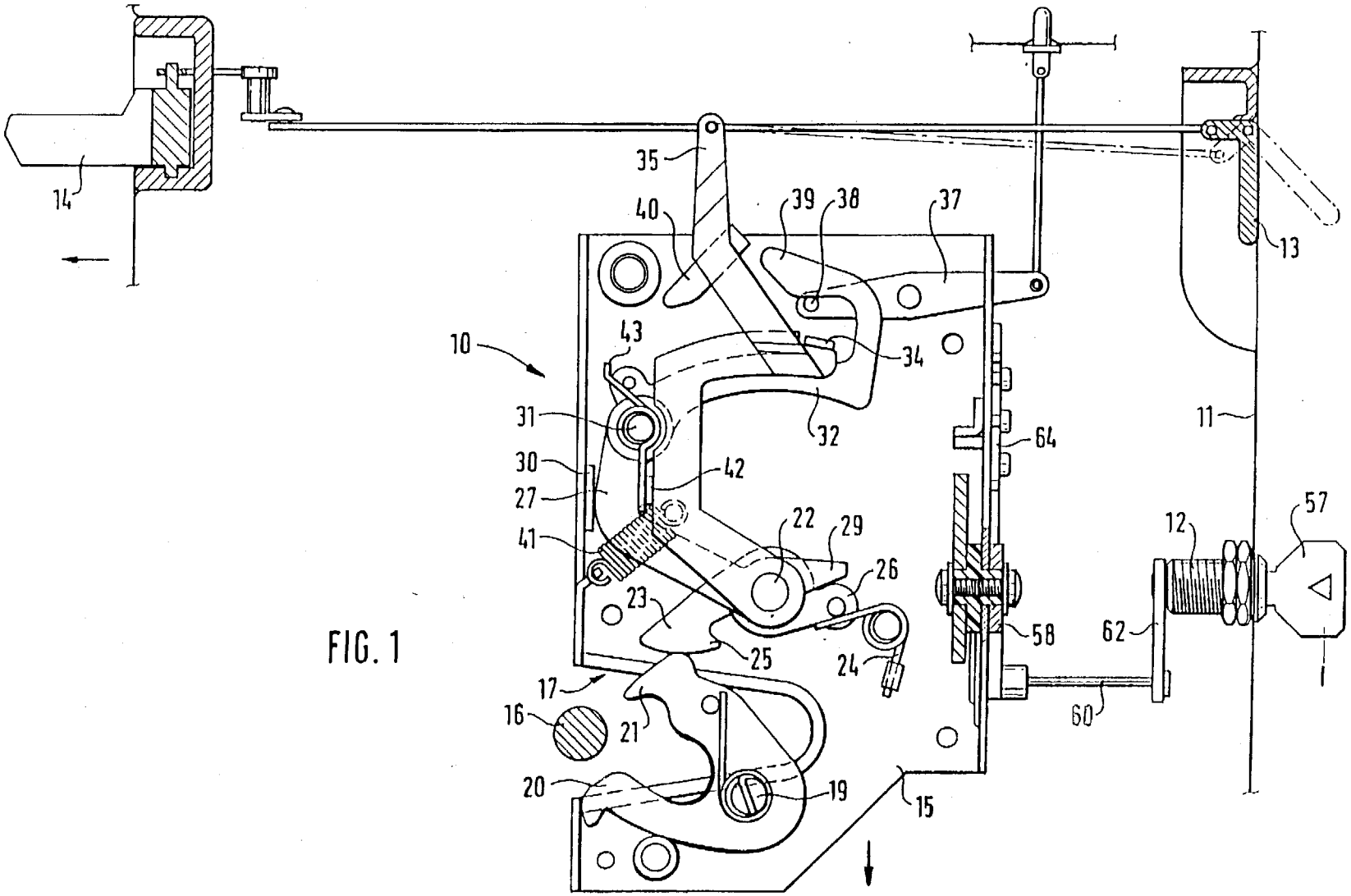

The blocking device provided for motor vehicles has door locks 10 associated with the individual doors 11 of the motor vehicle. FIG. 1 shows a lock 10 in a simplified manner and a door 11 with lock cylinder 12, outside door handle 13 and inside door handle 14 schematically. Each individual door lock 10 has a support plate 15 at which the internal operating parts of the lock are arranged. Every door lock further contains a lock pin 16 arranged in the associated door post which is rigid with the body. When the door 11 is closed, the lock pin 16 engages in a slot-shaped cut out portion 17 of the support plate 15. A fork-shaped rotatable latch 20 serving as a blocking member which is rotatable about an axle 19 also projects into this cut out portion 17. This rotatable latch 20 has two legs 21, one of which can be locked optionally with a blocking member 23 which is rotatable about an axle 22. FIG. 1 shows an unlocked rotatable latch with open door. The blocking member 23 is under constant constraint by a restoring spring 24 to move into its locking position so that a locking blade 25 arranged on the blocking member engages behind one of the legs 21 of the rotatable latch 20 when the door is closed (compare FIGS. 2 and 12). When the door is closed, however, the legs 21 drive back the locking blade 25 of the blocking member 23 so that locking is possible.

The blocking member 23 can also be opened by actuating its arm 26 located opposite the locking blade 25. This is effected via two unblocking levers 27 and 28 which are constructed so as to coincide with or cover one another approximately and are arranged adjacent to one another so as to be rotatable on axle 22. Each unblocking lever 27, 28 has a projection 29 contacting the arm 26. In its rest position shown in FIG. 1, the unblocking lever 27, 28 contacts a stop 30. The unblocking levers 27, 28 have joints 31 at which an actuating arm 32 for the outside door handle 13 and an actuating arm 33 for the inside door handle 14 are articulated so as to be movable within limits. A projecting driver 34 is arranged laterally at each actuating arm 32, 33. Two door handle levers 35 associated with unblocking levers 27, 28 are also supported so as to be swivelable about axle 22 in the same way as the unblocking levers 27, 28. Each of these door handle levers 35 has a driver nose 36 cooperating with the drivers 34.

For emergency locking, the door lock 10 has an emergency button which can be operated manually from inside and acts on an emergency locking lever 37. An index bar 38 is arranged at the end of the emergency locking lever 37 on the lock side and cooperates with an emergency locking hook 39 of the outer actuating arm 32 and with a restoring plate 40 at the door handle lever 35 for the inside door handle 14.

Each door handle lever 35 is compelled in the direction of the stop 30 by a tension spring 41 and, when striking a stop plate 42 at the associated unblocking levers 27, 28, presses the latter against the stop 30. A spiral spring 43 is arranged on the axle of the joint 31 between the unblocking levers 27, 28 and the actuating arms 32, 33, its projecting arms contacting the unblocking levers 27, 28 and actuating arms 32, 33, respectively, in such a way that the actuating arms are compelled toward the axle 22 in a downward direction with reference to FIG. 1.

Figure 2:
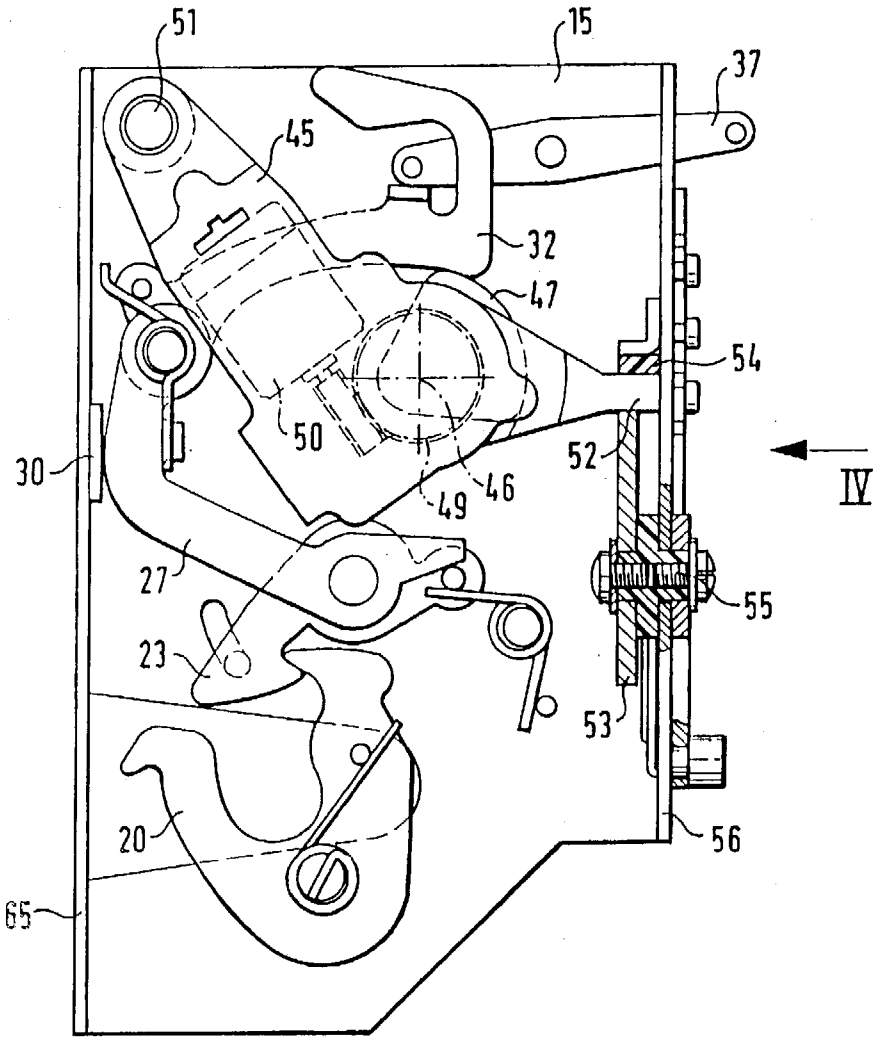

FIG. 2 shows the additional component parts of the door lock 10 which were not shown in FIG. 1 for the sake of simplicity. However, the door handle levers 35 are omitted in FIG. 2. The essential component of the door lock 10 is a control member 44 which acts on the actuating arms 32, 33. This control member 44 is held in a control member support 45 so as to be rotatable. The axis of rotation situated vertically to the control member support 45 and vertically to the extension of the actuating arm 32 is designated by 46. The control member 44 has two control cams 47, 48 located adjacent to one another. The outer control cam 47 shown in FIG. 2 acts on actuating arm 32 to open the door from the outside. Control member 44 also has a toothed wheel 49 which is arranged concentrically to the axis of rotation 46 and meshes with the screw of a small electric motor 50. The motor 50 is attached to the control member support 45 which is supported so as to be swivelable about an axle 51.

The control member support 45 has a supporting arm 52 which projects beyond the control member 44 and is held at the support plate 15 in contact at a stop 54 by an emergency unlocking lever 53 constructed as an eccentric. The emergency unlocking lever 53 is fastened to a swivel pin 55 which is supported in a side wall 56 of the support plate 15 having a 90-degree bevel and can be rotated by turning a key 57 in the lock cylinder 12 (see FIG. 1). In addition, an eccentric 58 is fastened to the outside of the side wall 56.

Figure 3:
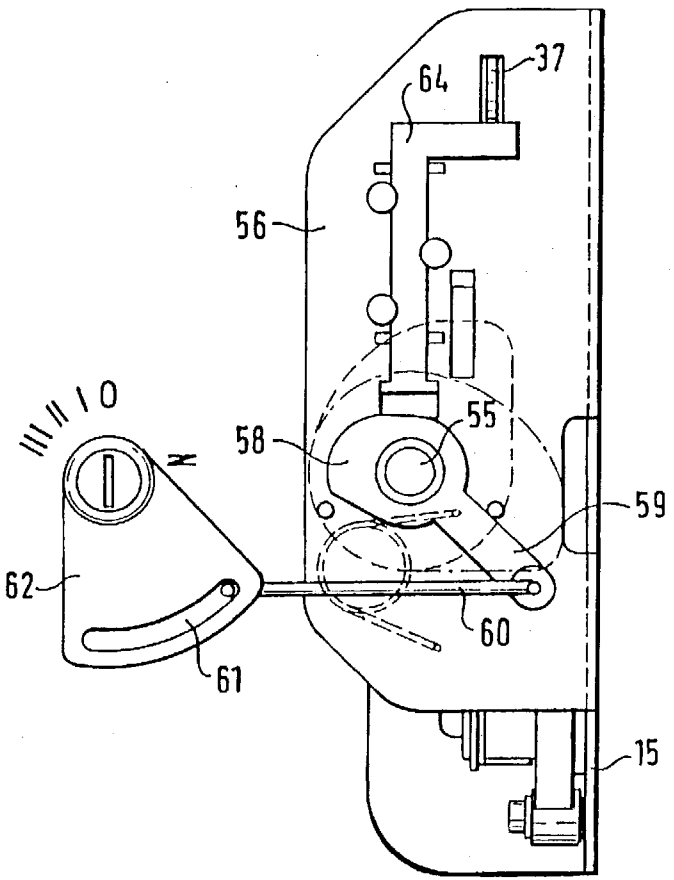

FIGS. 1 and 3 show eccentric 58 with a lever arm 59, a rod 60 connected with the lock cylinder 12 being rigidly connected with this lever arm 59. The other end of this rod 60 extends into an elongated hole 61 of a second lever arm 62 at the lock cylinder 12 (see FIG. 3). The elongated hole 61 ensures that the eccentric 58 is affected only when the key 57 is turned to the right, with reference to FIG. 3, into position N and not when turned to the left into positions I, II, III. The eccentric 58 acts on a slide 64 which is guided at the support plate 15. The emergency locking lever 37 is unlocked by lifting the slide 64.

Figure 4:
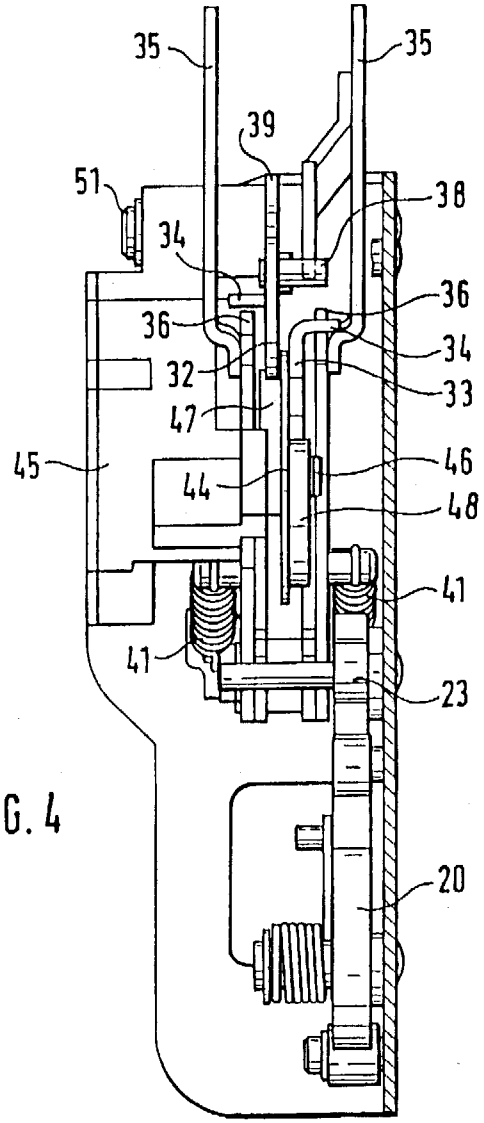

FIG. 4 shows a side view of a lock 10 in viewing direction IV in FIG. 2, the side wall 56 of the support plate 15 being omitted in this figure. The individual structural components shown here have already been explained with reference to the preceding figures. The control cams 47 and 48 acting on the actuating arms 32 and 33 can be seen particularly clearly. Control cam 47 is directed upward and lilts the actuating arm 32 so that the driver nose 36 at the door handle lever 35 for the outside handle cannot reach the driver 34. In this position of the control member 44, the door in question cannot be opened from the outside. Control cam 48 is rotated downward so that, in this case, the driver nose 36 of the door handle lever 35 can grasp the driver 34. Thus, when actuating the door handle lever 35 from the inside, the actuating arm 33 is carded along so that the rotatable latch 20 is released.

Figure 5:
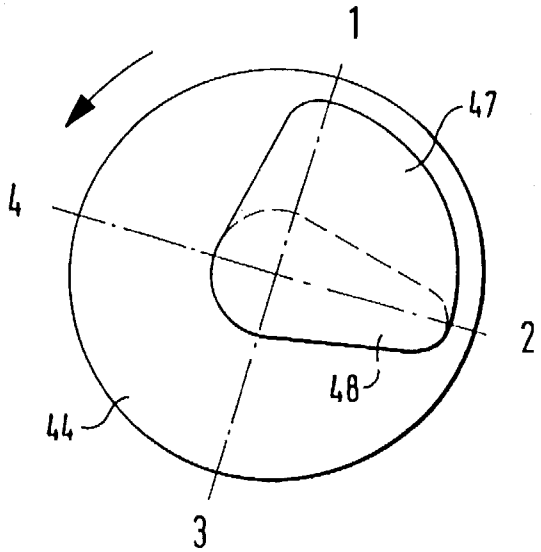
Figure 6:
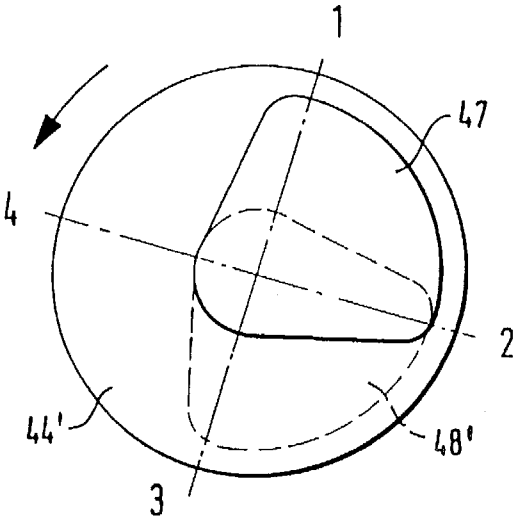

FIGS. 5 and 6 show separate views of control members 44 for the driver's door and front door. The control member 44 can be rotated in the direction of the arrow into four different positions by the motor 50. There are four sectors 1 to 4 which may or may not be occupied by control cams depending on the locking function. Control cam 47 for actuating the door from the outside covers sectors 1 and 2. However, the control cam 48 located in back in FIG. 5 which serves to actuate the door from the inside covers only sector 2. Control member 44' in FIG. 6 differs from control member 44 only in that the control cam 48' is constructed differently. Control cam 48' for actuating the door from the inside also covers sector 3 in addition to sector 2. Oppositely located cams 47/48 are always constructed and arranged in such a way that they do not both begin in the same sector and only one of the two actuating arms 32, 33 is tilled at one time when the control member is rotated farther in the direction of the arrow.

The two control members 44, 44' have the same locking functions for the four sectors 1 to 4. The sector which is directed toward the actuating arm 32 slightly diagonally at the upper right in door lock 10 (see also FIG. 2) is crucial for the locking function. In sector 1, the doors are centrally locked, i.e., the outside door handles 13 are ineffective and all doors can be opened from the inside by pulling on the inside door handles 14. When sector 2 is effective, the vehicle has "anti-theft protection", i.e., all door handles have no effect when pulled and none of the doors can be opened from the outside or from the inside. In sector 3, child-proof locking is in effect, i.e., the forward doors can be opened from the inside and from the outside but the rear doors can only be opened from the outside. In sector 4, all doors are "unblocked", that is, they can be opened from the inside and also from the outside by pulling on the door handles.

The position of the actuating arms 35 and additional levers of the lock 10 in the various locking functions is shown in the following figures.

Figure 8:
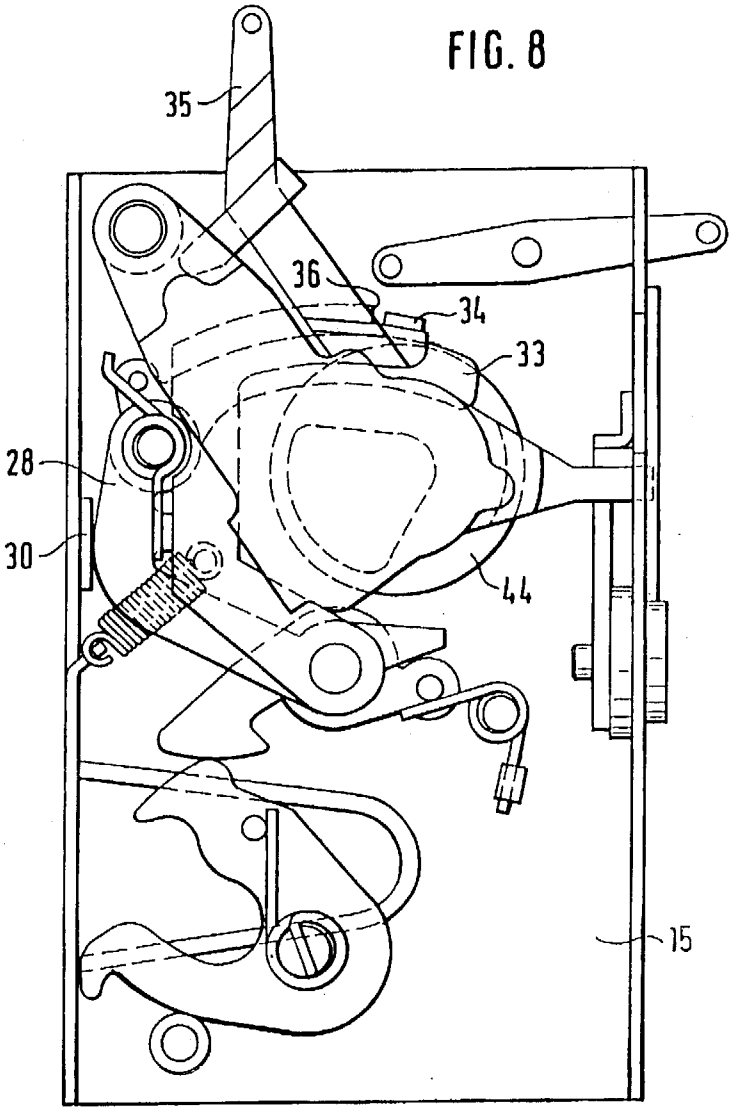
Figure 7:
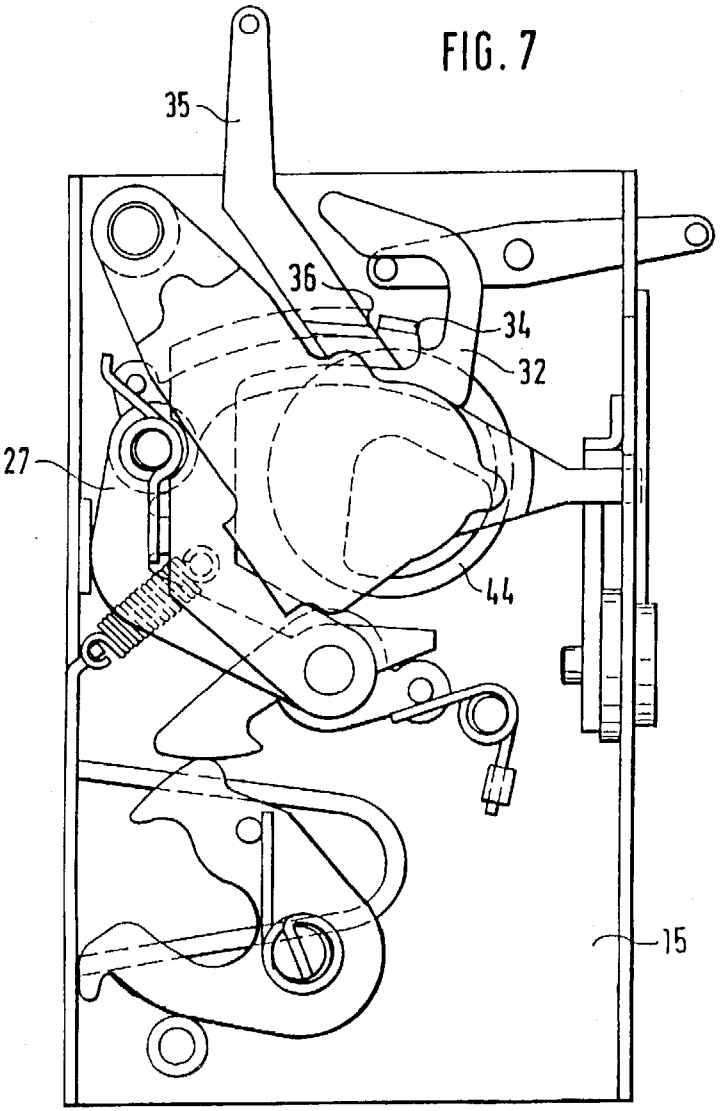
Figure 9:
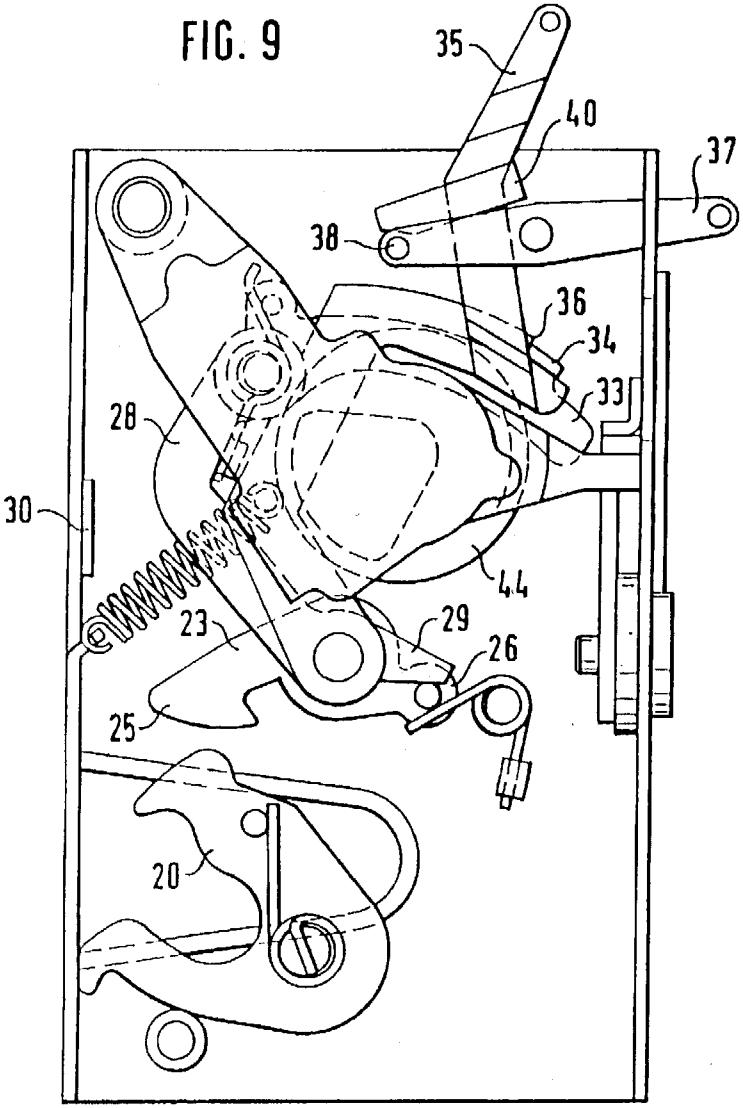

FIGS. 7 to 9 show "unblocked" locking function, in which sector 4 of the control members is effective in each instance. Parts which might not be shown in these figures are designated by the same reference numbers as in the preceding figures. The two actuating arms 32 and 33 are located in the same lower position in the neighborhood of the control members 44. In this position, the drivers 34 at the actuating arms 32/33 are grasped by the driver noses 36 at the door handle levers 35 and drawn along toward the right when the door handles 13, 14 or door handle lever 35 are actuated so that the respective unblocking levers 27, 28 move away from their stop 30. This is shown in FIG. 9 for actuation from the inside. The projection 29 at unblocking lever 28 presses the blocking member 23 down at its arm 26 so that the locking catch 25 releases the rotatable latch 20. In this case, if the emergency locking lever 37 were actuated, its arm carrying the index bar 38 would be pressed down by the restoring plate 40.

Figure 10:
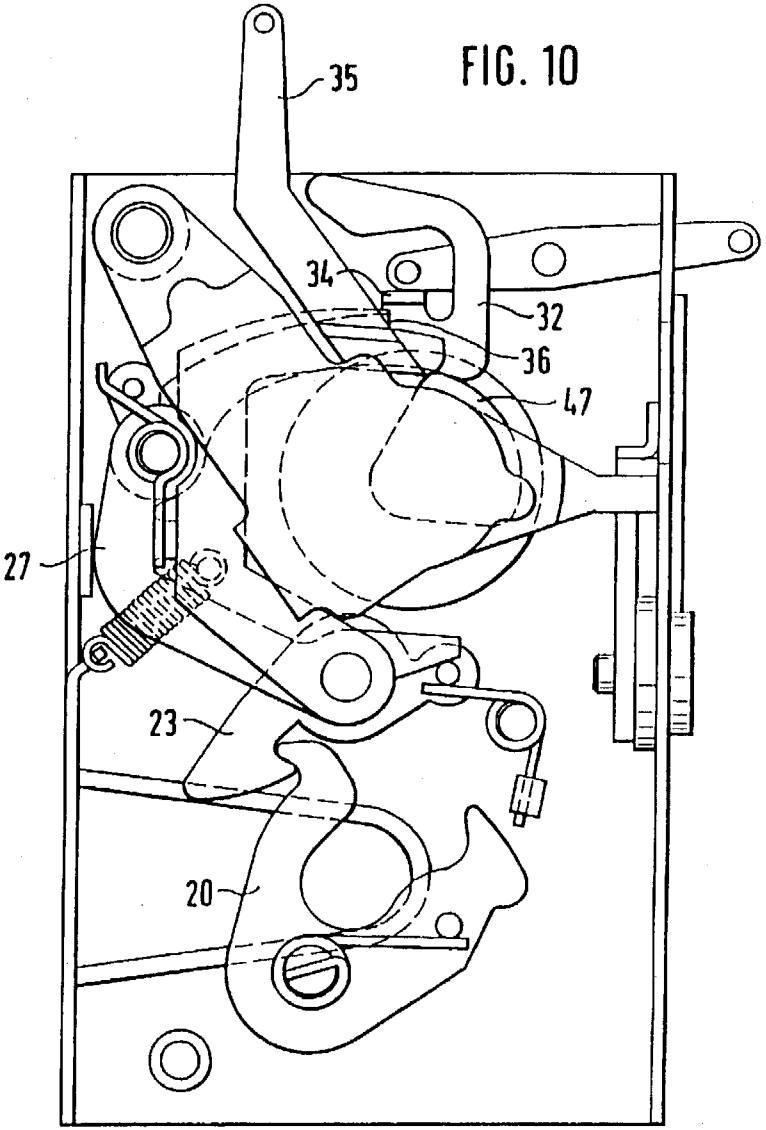

FIG. 10 shows the "central locking" function in which none of the doors can be opened from the outside. Only the lever position for outside actuation is shown. Control cam 47 is swiveled up as shown in FIG. 2 so that sector 1, shown in FIG. 5, is directed toward actuating arm 32. The actuating lever 32 is lifted so that the driver nose 36 does not reach the driver 34 and the door handle lever 35 can be drawn through between control cam 47 and driver 34 without resistance and without effect. Thus, when the outside door handle is actuated, only door handle lever 35 moves. The actuating arm 32 and unblocking lever 27 remain stationary so that the blocking member 23 also holds rotatable latch 20 in its closed position. In central locking operation, the lever position for inside actuation corresponds to the view in FIGS. 8 and 9 and the doors are unblocked from the inside.

Figure 12:
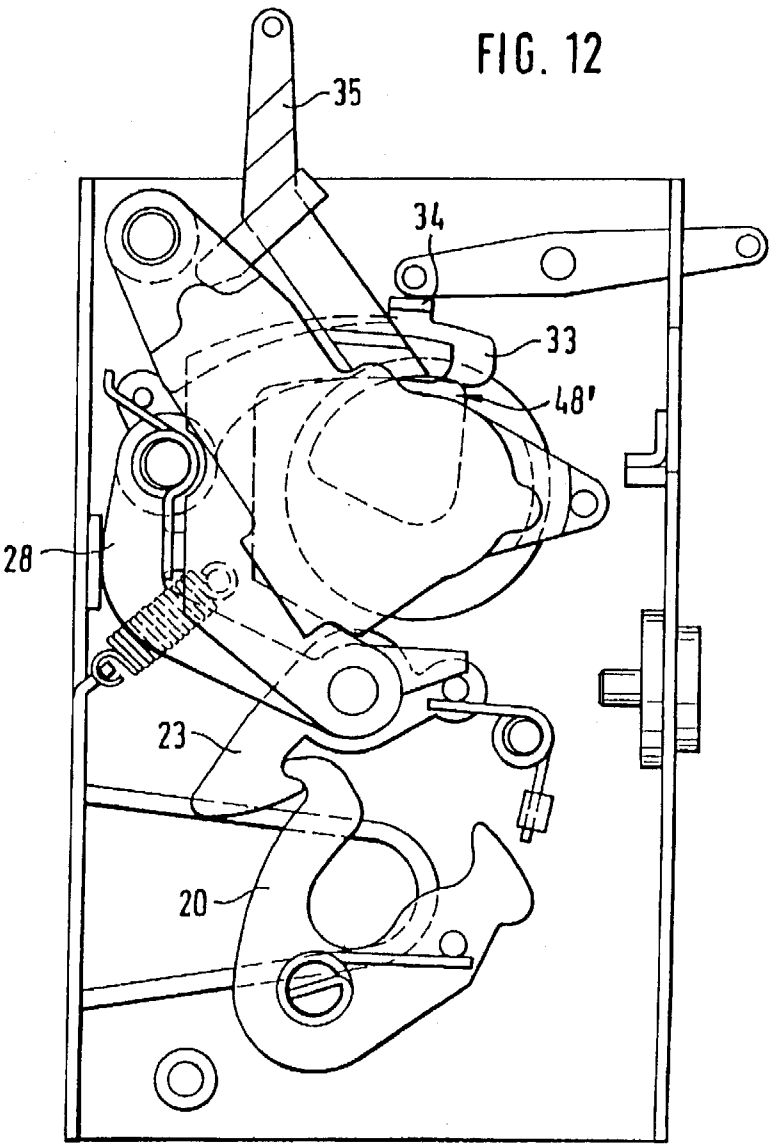
Figure 11:
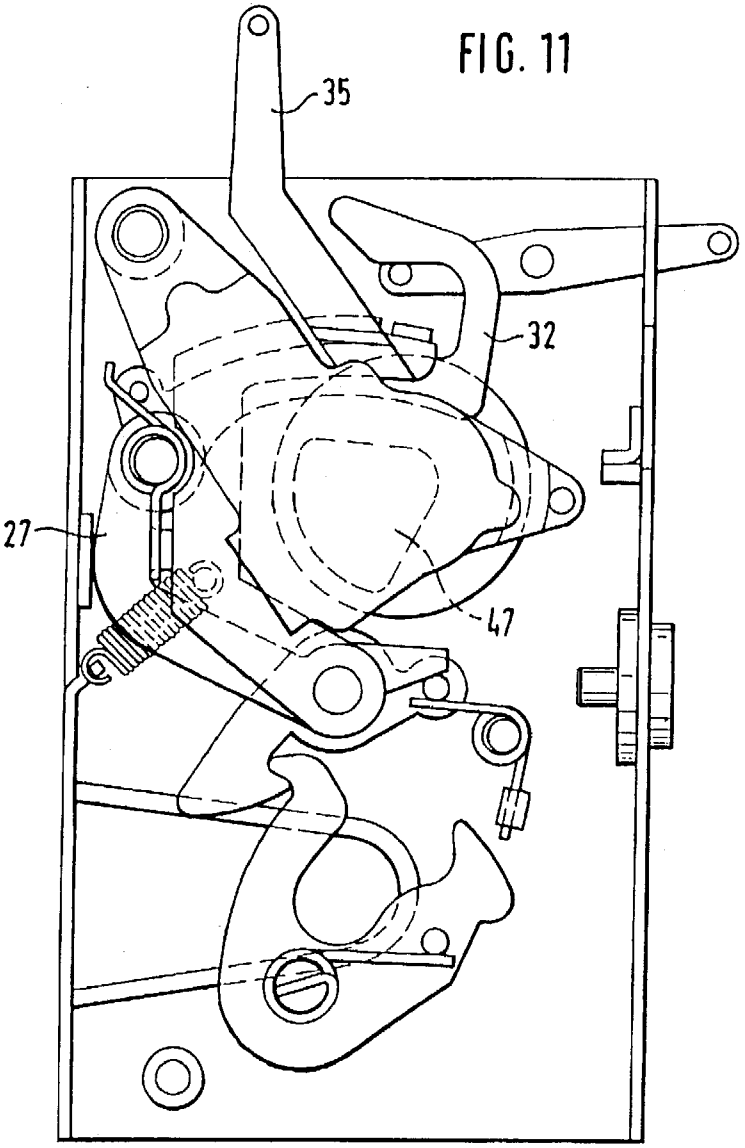

The child-protection function is shown in FIGS. 11 and 12. The control cam 47 for outside actuation does not lift the actuating arm 32 so that it is possible to open the door as in the position according to FIG. 7. However, the control cam 48' covering sector 3 for inside actuation does lift the actuating arm 33. Now, when the door handle lever 35 is actuated from the inside, it can be pulled freely without affecting the blocking member 23 or rotatable latch 20 exactly as was shown in FIG. 10 with respect to outside actuation.

Figure 14:
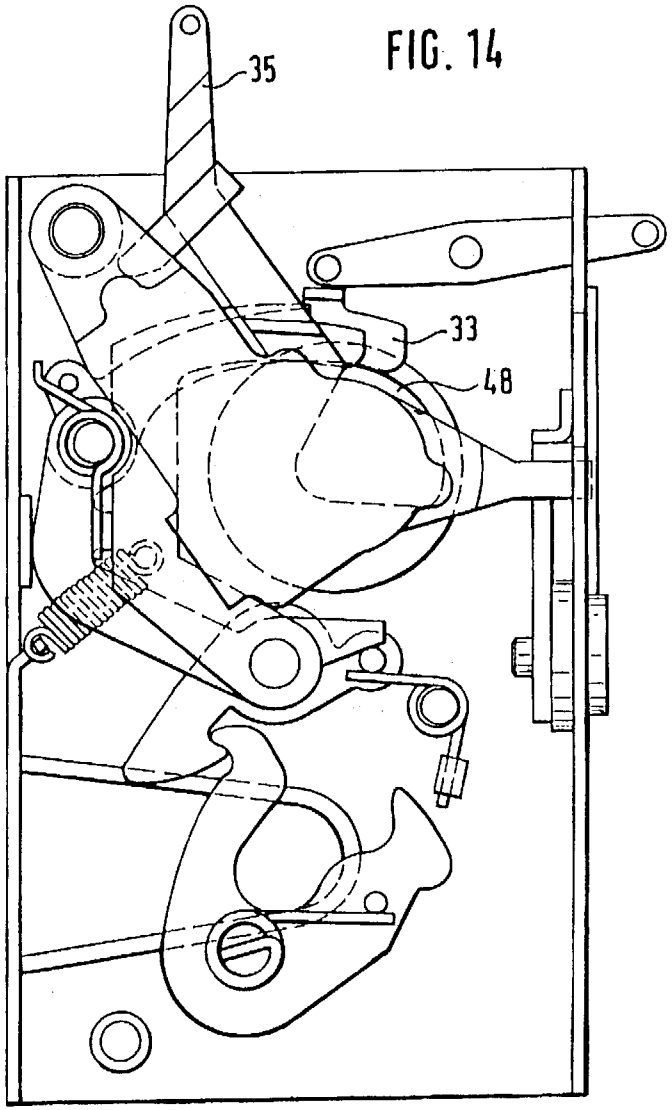
Figure 13:
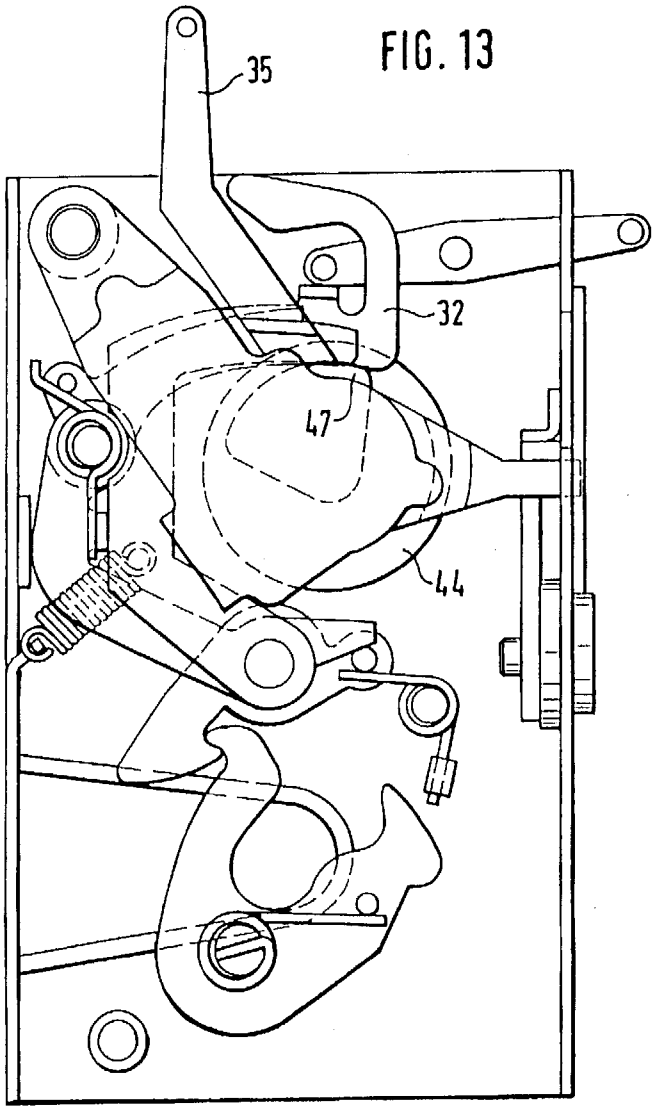

The anti-theft locking function is shown in FIGS. 13 and 14. Both actuating arms 32 and 33 are lifted by cams 47 and 48 so that both door handle levers 35 can be pulled freely. The doors can be opened neither from the inside nor from the outside.

Figure 15:
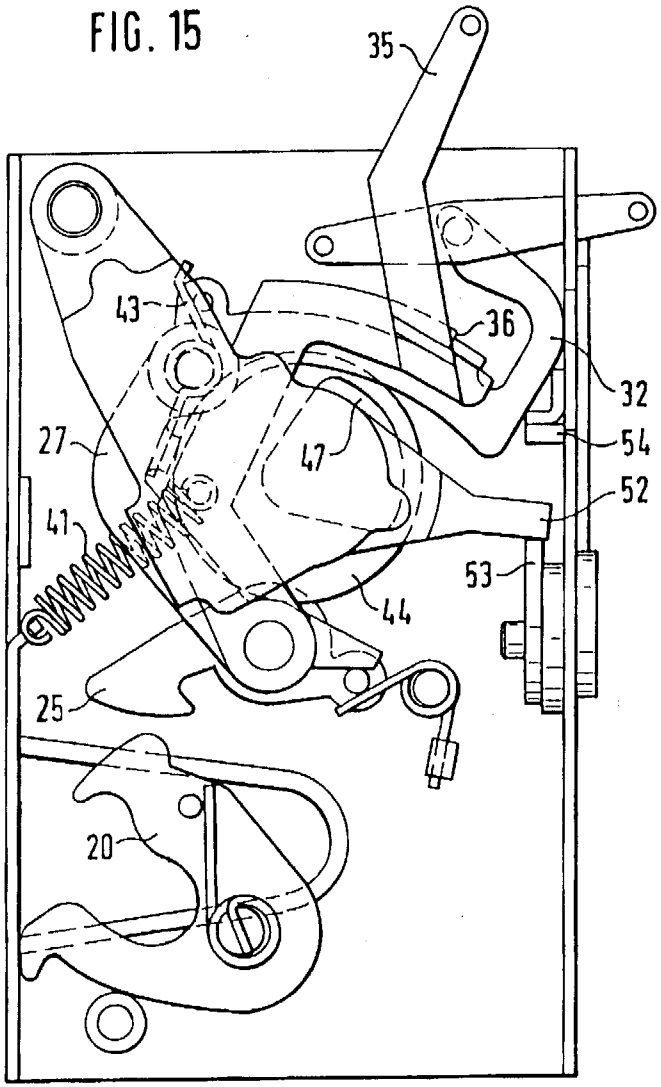

FIG. 15 shows a door with anti-theft protection with emergency unlocking, e.g., due to power failure. For the purpose of emergency unlocking, the emergency unlocking lever 53 is actuated manually by the key so that it releases the supporting arm 52. The latter moves downward away from the stop 54 and the control member 44 with control cams 47, 48 also moves downward. The actuating arms 32 and 33 (33 not shown) follow due to the action of the springs 43. The lowered actuating arms can now be reached again by the driver noses 36 of the actuating levers 35. In FIG. 15, the lock is shown in the opened position in which the rotatable latch 20 is released.

Figure 16:
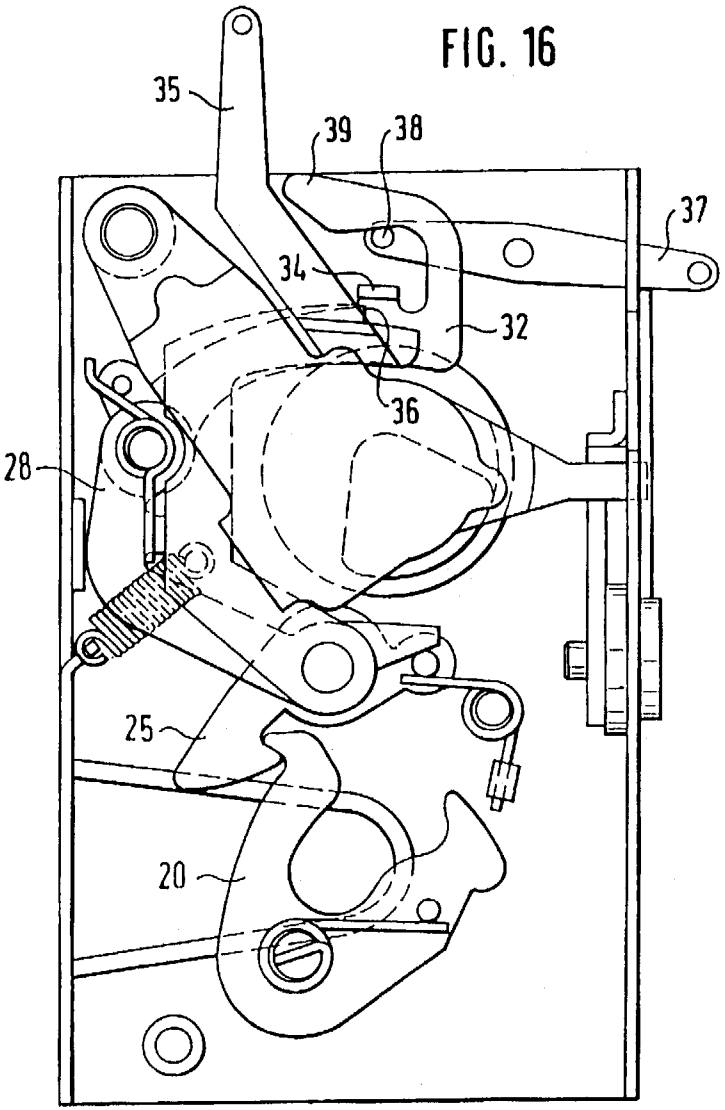
Figure 17:
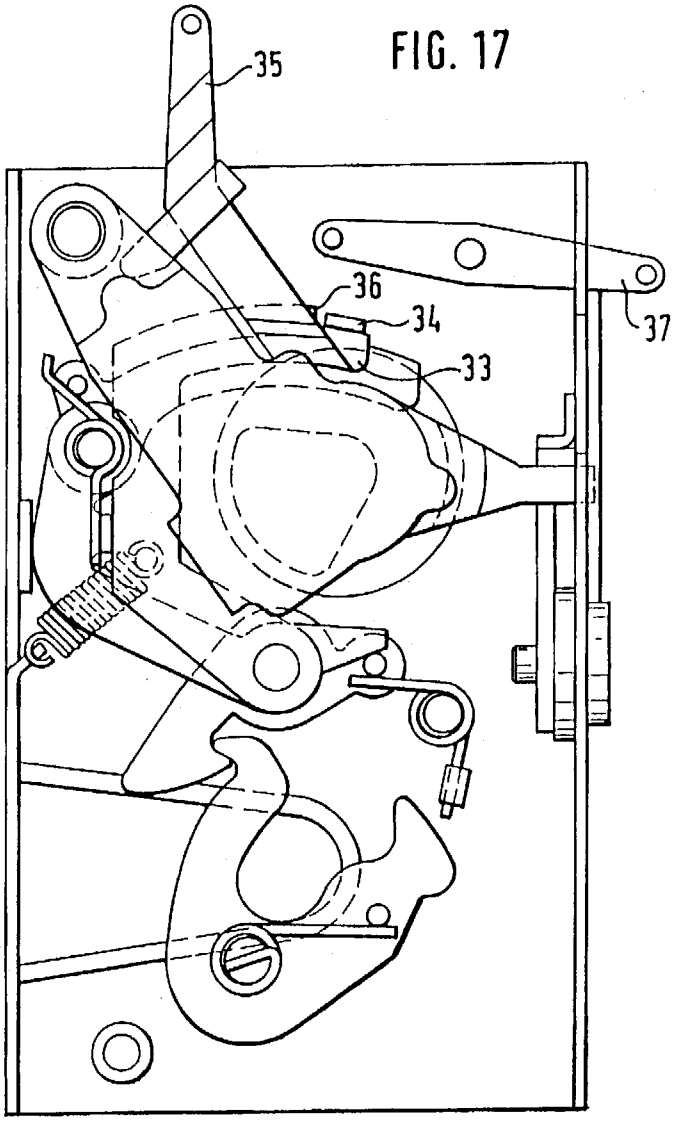

FIGS. 16 and 17 show an emergency-locked lock which may be required in case of power outage or motor failure. For emergency locking, the emergency locking lever 37 is actuated from the inside of the vehicle in such a way that the index bar 38 lifts the emergency locking hook 39 and accordingly the actuating arm 32. Accordingly, the driver 34 again moves outside the swiveling range of the driver nose 36 so that the door handle lever 35 can be pulled freely for outside actuation. FIG. 17 shows that the doors can, however, be opened from the inside: the actuating arm 33 has no emergency locking hook so that it remains in its lowered position and the driver 34 can be grasped by the driver nose 36.

We claim:

1. A blocking device for doors, hatches and hoods of a motor vehicle, comprising outside and inside door handles; at least one lock having a blocking element cylinder actuateable from outside; said lock arrangeable in a door and having a blocking element formed as a rotatable latch, and a supporting member arrangeable in a door frame so that said blocking element cooperates with said supporting member; a blocking member blocking said blocking element in a closed position; unblocking means unblocking said blocking element; a control member which influences movability of said unblocking means and is adjustable; motor means adjusting said control member, said unblocking means including two unblocking levers, said unblocking levers being swivelable independently of one another; door handle levers connected with said door handles and arranged so that said unblocking levers cooperate with said door handle levers, said door handle levers being actuatable so that independently of one another but depending on a position of said control member said door handle levers operate in one of the ways selected from the group consisting of acting on a respective one of said unblocking levers or pullable without effect so as not to influence said unblocking levers.

2. A blocking device as defined in claim 1, wherein said unblocking levers have drivers; and further comprising actuating arms, said drivers being arranged at said actuating arms and connected with said unblocking levers so as to move in a spring-loaded manner, and also graspable by said door handle levers connected with said door handles.

3. A blocking device as defined in claim 1, wherein said unblocking levers have drivers, said control member having control cams arranged so that said drivers are movable into two different positions independently of one another by said control cams of said control member, and said drivers being graspable by said door handle levers in one position and not in another position.

4. A blocking device as defined in claim 3; and further comprising a spring applying a spring force, said drivers and actuating arms being liftable by one of said control cams and also being lowerable against said spring force when said control cams are rotated further.

5. A blocking device as defined in claim 1, wherein said unblocking levers have drivers, said door handle levers having driver noses which pass said drivers without effect when said lock is locked and said door handles are actuated.

6. A blocking device as defined in claim 1; and further comprising a common axle around which said unblocking levers and said door handle levers are rotatable.

7. A blocking device as defined in claim 1; and further comprising an emergency unlocking lever; an axle; and a control member support which is fastened to said axle and is swivelable away by said emergency unlocking lever, said motor means and said control member being arranged on said control member support.

8. A blocking device as defined in claim 7; wherein said emergency unlocking lever is formed as an eccentric actuatable from outside by a key.

9. A blocking device as defined in claim 7; wherein said emergency unlocking lever is operable manually and acts on a driver to transfer said driver into a position in which it is reachable by a door handle lever.

10. A blocking device as defined in claim 7; and further comprising an actuating arm for locking from outside, said emergency unlocking lever being operable manually and acting on said actuating arm to transfer said actuating arm into a position in which it is reachable by a door handle lever.

11. A blocking device for doors, hatches or hoods and a motor vehicle, comprising outside and inside door handles; at least one lock cylinder actuatable from outside; at least one lock, each having a blocking element formed as a rotatable latch, and a supporting member arrangeable in a door frame so that said blocking element cooperates with said supporting member; a blocking member which blocks said blocking element in a closed position; unblocking means which unblock said blocking element; a control member influencing a movability of said unblocking means and being adjustable; a motor adjusting said control member, said unblocking means including two unblocking levers provided with drivers for each lock, said unblocking levers being swivelable independently of one another and being associated with a respective one of said door handles, said control member being provided with control cams arranged opposite to one another so as to be offset in such a way to move said drivers of said unblocking levers when said control member is rotated.

12. A blocking device as defined in claim 11; and further comprising actuating arms; and door handle levers connected with said door handles, said drivers being arranged at said actuating arms and connected with said unblocking levers so as to be movable in a spring-loaded manner and graspable by said door handle levers connected with said door handles.

13. A blocking device as defined in claim 11; and further comprising door handle levers connected with said door handles, said drivers being movable into two different positions independently of one another by said control cams of said control member and graspable by said door handle levers in one position and not in another position.

14. A blocking device as defined in claim 11; and further comprising a spring applying a spring force, said drivers and actuating arms being liftable by one of said control cams and lowerable again by said spring force when said control cams are rotated further.

15. A blocking device as defined in claim 11; wherein door handle levers having driver noses which pass said drivers without effect when said lock is locked and said door handles are actuated.

16. A blocking device as defined in claim 11; and further comprising a common axle around which said unblocking levers and also door handle levers are rotatable.

17. A blocking device as defined in claim 11; and further comprising an emergency unlocking lever; an axle; and a control member support which is fastened to said axle and is swivelable away by said emergency unlocking lever, said motor and said control member being arranged on said control member support.

18. A blocking device as defined in claim 17, wherein said emergency unlocking lever is formed as an eccentric actuatable from outside by a key.

19. A blocking device as defined in claim 17, wherein said emergency unlocking lever is operable manually and acts on a driver to transfer said driver into a position in which it is reachable by a door handle lever.

20. A blocking device as defined in claim 17; and further comprising an actuating arm for locking from outside, said emergency unlocking lever being operable manually and acting on said actuating arm to transfer said actuating arm into a position in which it is reachable by a door handle lever.

* * * * *